US007789740B2

(12) United States Patent
Janesky

(10) Patent No.: US 7,789,740 B2
(45) Date of Patent: Sep. 7, 2010

(54) CRAWLSPACE AIR APPARATUS

(76) Inventor: Lawrence M. Janesky, 60 Silvermine Rd., Seymour, CT (US) 06483

( * ) Notice: Subject to any disclaimer, the term of this patent is extended or adjusted under 35 U.S.C. 154(b) by 0 days.

(21) Appl. No.: 11/558,656

(22) Filed: Nov. 10, 2006

(65) Prior Publication Data

US 2008/0113606 A1 May 15, 2008

(51) Int. Cl.

| | |
|---|---|
| ***F24F 7/007*** | (2006.01) |
| ***F24F 7/00*** | (2006.01) |
| ***E02D 19/02*** | (2006.01) |
| ***E02D 31/02*** | (2006.01) |

(52) U.S. Cl. ..... 454/251; 454/185; 454/186; 454/238; 52/169.14

(58) Field of Classification Search ..... 454/185, 454/186, 276, 238, 251; 52/169.14
See application file for complete search history.

(56) References Cited

U.S. PATENT DOCUMENTS

| | | | | | |
|---|---|---|---|---|---|
| 4,476,921 | A * | 10/1984 | Stubbolo | 165/48.1 |
| 4,578,912 | A * | 4/1986 | Ericsson | 52/169.5 |
| 4,598,558 | A * | 7/1986 | Bingham | 62/324.1 |
| 4,620,398 | A * | 11/1986 | Wallin | 52/169.1 |
| 4,905,579 | A * | 3/1990 | Dame | 454/238 |
| 5,052,442 | A * | 10/1991 | Johannessen | 137/813 |
| 5,544,453 | A * | 8/1996 | Engwall | 52/169.5 |
| 5,620,368 | A * | 4/1997 | Bates et al. | 454/186 |
| 5,954,046 | A * | 9/1999 | Wegler | 126/617 |
| 6,145,750 | A * | 11/2000 | Carpenter | 236/44 A |
| 6,319,115 | B1 * | 11/2001 | Shingaki | 454/186 |
| 6,575,666 | B1 * | 6/2003 | Janesky | 405/270 |
| 6,676,506 | B2 * | 1/2004 | Steneby et al. | 454/186 |
| 6,752,713 | B2 * | 6/2004 | Johnson, Jr. | 454/186 |
| 6,958,010 | B1 * | 10/2005 | Reese | 454/239 |
| 2002/0124992 | A1 * | 9/2002 | Rainer et al. | 165/11.1 |
| 2003/0084638 | A1 * | 5/2003 | Vacek | 52/741.3 |

FOREIGN PATENT DOCUMENTS

| | | | |
|---|---|---|---|
| JP | 06280933 | A * | 10/1994 |

* cited by examiner

*Primary Examiner*—Steven B McAllister
*Assistant Examiner*—Patrick F. O'Reilly, III
(74) *Attorney, Agent, or Firm*—Perman & Green, LLP

(57) ABSTRACT

A crawlspace encapsulation system for encapsulating a crawlspace of a building. The system includes a substantially impermeable barrier layer disposed in the crawlspace and isolating at least a portion of the crawlspace from an outside atmosphere and an air circulation system located in the isolated portion.

19 Claims, 6 Drawing Sheets

CRAWLSPACE AIR APPARATUS

BACKGROUND

1. Field

The present embodiments relate to encapsulation and isolation for at least partially subterranean chambers of buildings.

2. Brief Description of Related Developments

Moisture is very damaging to wood structural support members of buildings and is absorbed by such members from the ground and from moist air in contact therewith.

Many buildings and homes are built without basements, and are elevated a few feet above the ground on support members such as stone, poured concrete or concrete block walls. In many cases the crawlspace between the ground surface and the wooden floor beams or joists of the house is at a level below the level of the surrounding soil, or below the level of saturated soils in wet weather, so that water flows into and is absorbed up through the floor of the crawlspace, usually a dirt surface, from adjacent ground areas of higher elevation and up from the sub-soil. Such water is drawn into the headroom of the crawl space in the form of water vapor and penetrates the wooden structural members of the building, causing wood rot, mold, odors, attraction of ants and other insects, rodents etc. Also, the escape of dangerous radon gas from the ground into the crawlspace and into the building is another problem.

Even in crawlspaces that do not leak or flood from groundwater, the earth below the crawlspace, and forming the floor of the crawlspace, has a high humidity level most of the time, and this water vapor rises into the crawlspace to produce a humid air atmosphere within the crawlspace, which moves upwardly to penetrate the structural framing and living spaces above the crawlspace.

Mold spores exist in air and grow into destructive mold in the presence of damp organic material, such as moist wood. Humidity levels of from 50% to 90% are common in crawlspaces, even those that have never flooded. Mold can grow on dirt, insulation, wood framing and even under carpeting on the floor within the home. Mold digests and destroys organic materials as it feeds on them. Damp environments also provide an inviting environment for insects such as termites, ants and similar critters that feed on moist organic material such as structural support wood and can contribute to the destruction and collapse thereof.

Vents may also be provided though the walls of the crawlspaces to allow moisture within the crawlspace to evaporate and exit the crawlspace. However, unless there is a breeze or a temperature or pressure differential between the air in the crawlspace and the atmospheric air outside the crawlspace the air will not flow in or out of the crawlspace vents. When air is flowing through the crawl space vents the volume of air exchanged through the vents may not be sufficient to prevent high humidity levels and mold growth. In addition, insects and other critters may enter and exit the crawlspace through the crawlspace vents. Outside air may also be forced, such as via a fan, into the crawlspace. This however is also unsatisfactory as exterior air is hot and humid in the summer, thereby contributing to condensation on crawlspace surfaces, and cold in winter robbing the crawlspace of insulative effectiveness.

SUMMARY

In one exemplary embodiment, a crawlspace encapsulation system for encapsulating a crawlspace of a building is provided. The system includes a substantially impermeable barrier layer disposed in the crawlspace and isolating at least a portion of the crawlspace from an outside atmosphere and an air circulation system located in the isolated portion.

In another exemplary embodiment, a crawlspace encapsulation system for encapsulating a crawlspace of a building is provided. The system includes a substantially impermeable barrier layer disposed in the crawlspace and isolating at least a portion of the crawlspace from an outside atmosphere and an air exchange system connected to the isolated portion. The air exchange system is configured to feed air into the isolated portion of the crawlspace from a habitable area of the building.

In one exemplary embodiment, an air circulation system for a building having a habitable portion and a crawlspace is provided. The system includes a crawlspace encapsulation system for isolating the crawlspace from the earth and outside atmosphere, a fan unit and an inlet connected to the fan unit. The fan unit draws air from the habitable portion of the building through the inlet and the air is exhausted into the crawlspace.

In another exemplary embodiment, an air circulation system for circulating air within a crawlspace is provided. The system includes a fan unit mounted within the crawlspace of a building, the crawlspace being isolated from an outside atmosphere, an inlet connected to the fan unit for admitting conditioned air into the crawlspace from a habitable area of the building and an outlet mounted within the crawlspace for admitting air from the crawlspace into the habitable area for re-conditioning of the air.

BRIEF DESCRIPTION OF THE DRAWINGS

The foregoing aspects and other features of the present embodiments are explained in the following description, taken in connection with the accompanying drawings, wherein.

DETAILED DESCRIPTION OF THE EXEMPLARY EMBODIMENT(s)

Figure 1:
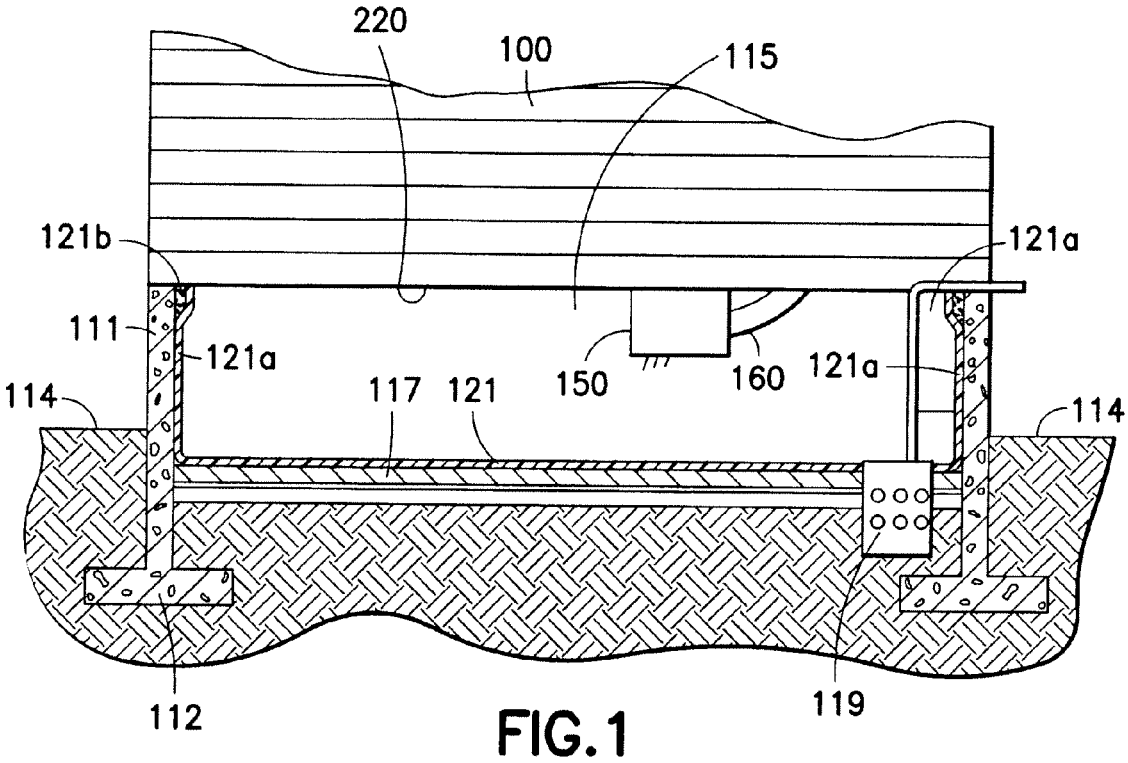
FIG. 1 illustrates a crawlspace encapsulation system incorporating features of an exemplary embodiment.

FIG. 1 shows a building structure having a crawlspace incorporating features of an exemplary embodiment. Although the present embodiments will be described with reference to the examples shown in the drawings and described below, it should be understood that the present embodiments could be embodied in many alternate forms. In addition, any suitable size, shape or type of elements or materials could be used.

As can be seen in FIG. 1, in the exemplary embodiment a building 100 such as a house is illustrated supported upon peripheral foundation walls 111 such as a cement block wall on a peripheral footing 112 buried in the ground beneath the frost line. The foundation walls form at least a partially subterranean chamber or crawlspace 115. Also, an access opening (not shown) may be provided in the foundation 111, above ground level 114, or a hatch door may be provided in the roof or ceiling 220 of the crawlspace 115 to permit access into the crawlspace 115 when necessary. In the exemplary embodiment, the crawlspace may be isolated by an encapsulation system from underground moisture and access and from the outside atmosphere. Any air vents present in the crawlspace walls 111 or foundation optionally may be sealed or covered with a crawlspace liner of the encapsulation system as will be described below to prevent undesired infiltration into the crawlspace interior 115 by water, moisture, vapors, etc. Air flow in the crawlspace may be provided by an air apparatus 250 (see also FIG. 2) that may draw air from inside the living or otherwise habitable area 200 of the building 100 as will be described further below.

The exemplary air apparatus 250 described herein may work in conjunction with a crawlspace encapsulation system such as that described in U.S. Pat. No. 6,575,666, the disclosure of which is incorporated herein in its entirety, to provide conditioned air circulation within the environmentally sealed crawlspace. In alternate embodiments, the air apparatus 250 may be installed as a stand alone unit or in combination with any other suitable crawlspace maintenance/preservation devices.

The crawlspace may be sealed with crawlspace liner 121. The crawlspace liner 121 is installed over the dirt floor 117 and around a sealed sump pit 119, if present, and is extended vertically-upwardly to the tops of the crawlspace walls and sealed against the inner surface of the foundation walls 111 peripherally surrounding and enclosing the crawlspace 115, as can be seen in FIG. 1.

The vertical peripheral crawlspace liner extensions 121*a* are extended and supported against the inner surfaces of the foundation walls 111 and sealed thereto at an elevation which is above the exterior ground level, preferably to the tops of the foundation walls. The crawlspace liner 121 substantially encapsulates the crawlspace environment and completely isolates the building envelope and upper living spaces from the earth therebelow and from the dampness, insects and radon contained therein, to prevent the entry of water vapor from the soil or ground into the crawlspace environment and to prevent external ground water or flood water entry into the crawlspace and on top of the crawlspace liner 121, over the dirt floor 117, where it can become trapped and stagnant and can generate mold and fungus and water vapor which can deteriorate and rot structural wood support members of the building 100. The crawlspace liner 121 is sealed contiguous to the top edge of the building foundation wall 111 by a continuous peripheral sealing bead 121*b* (see FIG. 1). In alternate embodiments, the crawlspace may be sealed or encapsulated in any suitable manner. To prevent the buildup of moisture, condensation or humidity due to the cooler temperatures within the crawlspace the air apparatus 250 may be installed within the sealed crawlspace. In alternate embodiments, the air apparatus 250 may be mounted in any desired area within the habitable area 200 or outside the building so that air is passed from the air apparatus 250 into the crawlspace through suitable pipes or ductwork.

Referring now to FIGS. 3-5D, the air apparatus 250 generally includes an inlet 390, a duct 160 and a fan unit 150. The inlet may have an adjustable air passage for controlling an amount of air (e.g. the mass flow rate) passing through the inlet as will be described below. The inlet 390 communicates with the habitable area 200 of the building. Fan unit 150, which may be joined to the inlet 390 by duct 160, draws air from area 200 and exhausts the air into the interior of the crawlspace 115.

Figure 2:
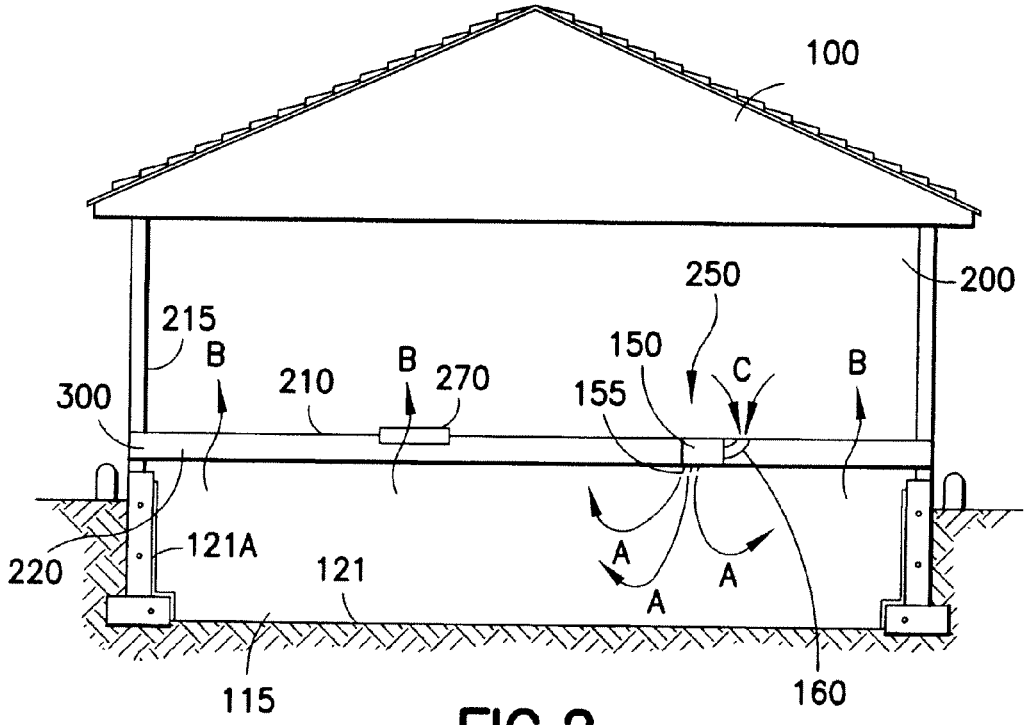
FIG. 2 shows air flow in a building structure in accordance with an exemplary embodiment.
Figure 5C:
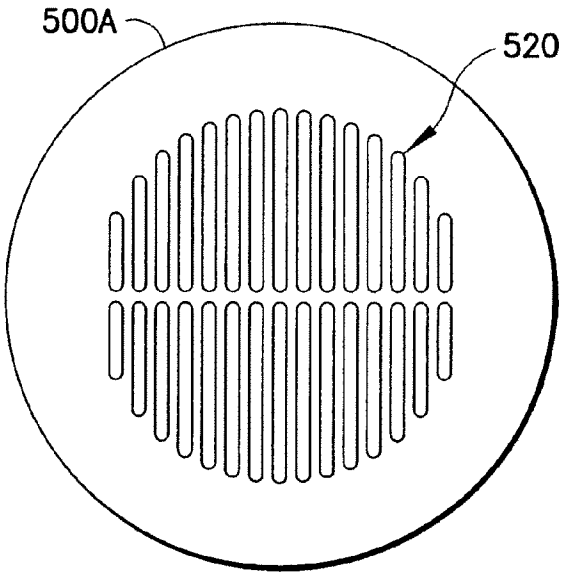
FIGS. 5A-5D show a grill in accordance with an exemplary embodiment.
Figure 5D:
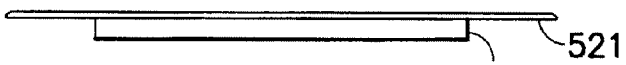
Figure 5A:
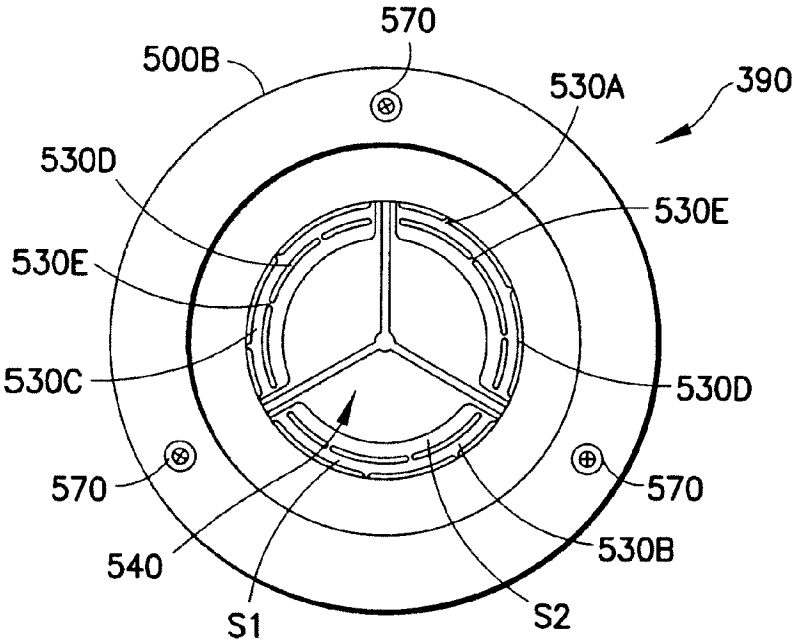
Figure 5B:
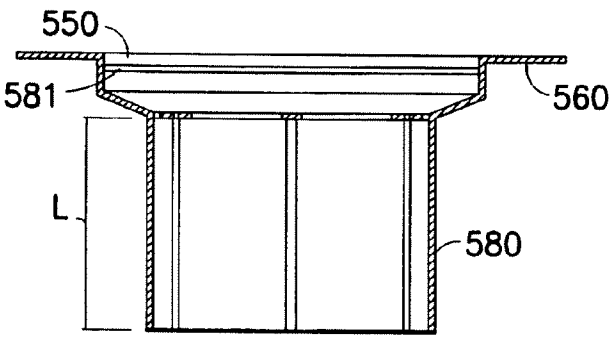
Figure 6:
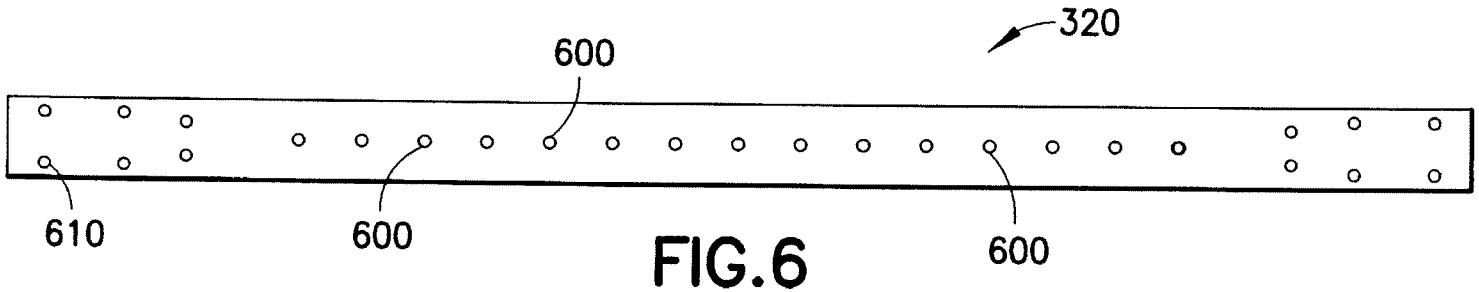
FIG. 6 illustrates a strap in accordance with an exemplary embodiment.

In the exemplary embodiment shown in FIG. 2, the air system inlet is depicted as being located in the floor of area 200 for exemplary purposes. In alternate embodiments, the inlet may be located in any desired region of area 200 and may be any suitable inlet. The inlet 390 of the exemplary embodiments is shown in FIGS. 5A-5D, and may include an upper portion 500A and a lower portion 500B. As shown in FIGS. 5A and 5C, the upper and lower portions 500A, 500B of the inlet 390 may have a circular shape of any suitable diameter, but in alternate embodiments the inlet may be any suitable shape such as, for example, rectangular. The inlet 390 may also be made of any suitable material such as, for example, plastic or metal. In this example, the lower portion 500B may include a mounting flange 560, a tubular section 580 for connection to any suitable duct and an air passageway 540. The flange 560 may include mounting holes 570 located around its perimeter for affixing the bottom portion 500B of the inlet 390 to, for example, the ceiling of the crawlspace or the interior of a wall with screws, nails or any other suitable fastening device. In alternate embodiments, the lower portion 500B may be affixed to a surface in any suitable manner such as with an adhesive.

The tubular portion 580 of the inlet 390 is shown in the drawings as being substantially straight or perpendicular with respect to the mounting flange 560, but in alternate embodiments the tubular portion 580 may have any configuration such as, for example, an elbow. In alternate embodiments, rather than having an elbow shape, the tubular portion 580 may be at any suitable angle to the mounting flange 560 to accommodate, for example, placing the inlet within a wall or ceiling. The tubular portion 580 may also have any suitable length L to provide a sufficient mounting surface for duct 160 to be attached to the inlet 390.

The lower portion 500B of the inlet 390 may be provided with a way to adjust the cross-section of the air passage to control (e.g. limit or increase) the amount of the air passing through the inlet 390. As can be seen in FIG. 5A, the lower portion 500B may be formed with, for example, any suitable number of knockouts or otherwise removable pieces 530A-530C having any suitable shape that may correspond to the cross-section of the air passageway 540 of the inlet 390. These knockouts 530A-530C may be used to adjust the cross-sectional area of the passageway 540 so that when the knockouts 530A-530C are removed the cross-section of the passageway 540 increases allowing more air to flow through the inlet 390. In this example, the knockouts 530A-530C may be divided into sections S1, S2 by slots 530D. The slots 530D are separated by ribs 530E. Each section S1, S2 of the knockouts 530A-530C may be removed to increase the cross-section of the passageway 540 by cutting or otherwise breaking the respective ribs 530E. In alternate embodiments, the knockouts may have any suitable configuration. In other alternate embodiments, the knockouts for adjusting the air flow may be located on the fan housing or an insert that may be located at, for example, any point along the duct connecting the inlet with the fan housing. In still other alternate embodiments any suitable method of adjusting the cross-section of the air passage may be employed such as, for example, an iris type constraining device in the case of a circular cross-section or a sliding block or plate in the case of a rectangular cross-section or a butterfly valve.

The upper portion 500A of the inlet 390 may include a plurality of air passages such as slots 520, a peripheral flange 521 and a rim 510. The slots 520 may allow air to pass into the inlet 390 and through the lower portion 500B while keeping debris from entering the air apparatus 250. The upper portion 500A may have any suitable number of slots having any suitable size and configuration. In alternate embodiments, in lieu of the slots 520 the inlet 390 may have, for example, a plurality of holes or any other suitable opening(s) for air to pass. The flange 521 may have any suitable dimensions to prevent the upper portion 500A from falling through, for example, an opening cut in a floor 210 (or a hole cut in the ceiling 220 of the crawlspace 115) of the building structure 100 through which the inlet 390 is installed. For example, the opening in the floor 210 may have a diameter smaller than the flange 520 but larger than the rim 510. It is noted that in alternate embodiments, the inlet may be mounted in any desired location and on any desired surface (floor, wall, ceiling, etc.) within, for example, the habitable area 200. The rim 510 may be of unitary construction with the upper portion 500A or in alternate embodiments it may be a separate piece attached to the upper portion 500A with a mechanical or chemical fastener or other suitable attachment method. The rim 510 may pass through the hole in the floor 210 and mate with the opening 550 of the lower portion 500B of the inlet 390. The rim 510 may be configured to snap into a recessed slot, such as slot 581 so that the upper portion 500A is retained by the lower portion 500B when the inlet 390 is installed. In alternate embodiments, the upper portion 500A may be prevented from separating from the lower portion 500B when installed by mechanical fasteners, such as screws, passing through the flange 521 and into the floor 210 or by an adhesive. In other alternate embodiments the upper portion 500A may be held in place in any suitable manner such as, for example, clips, threads (e.g. rim 510 and opening 550 have mating threads) or pins.

In alternate embodiments, the inlet may be in the form of grill having an upper portion with a peripheral mounting flange and a lower portion all having unitary construction. The upper and lower portions of the inlet may have a circular shape of any suitable diameter, but in other alternate embodiments the inlet may have any suitable shape such as, for example, rectangular. The upper portion of the inlet may have, for example, slots substantially similar to the slots 520 described above. The upper portion of the inlet may also include holes passing through the flange and located around the perimeter of the upper portion. The holes passing through the flange may be provided so that the inlet may be affixed to a surface such as, for example, a floor or wall with screws, nails or any other suitable fastening device. In other alternate embodiments, the inlet may be affixed to a surface in any suitable manner such as with an adhesive.

In this alternate embodiment, and as noted above, the lower portion of the inlet may be of unitary construction with the upper portion. In other alternate embodiments, the upper and lower portions may be joined in any suitable manner. The lower portion of the inlet may also have any suitable length so that when the inlet is affixed to a surface the lower portion extends through the surface a sufficient amount for connection to, for example, duct 160. The lower portion of the inlet may also be elbow shaped or at any angle with respect to the upper portion in a manner substantially similar to that described above for FIGS. 5A-5B.

In this alternate embodiment, the lower portion of the inlet may be provided with a way to adjust the cross-section of the air passage such as, for example, any suitable number of knockouts or otherwise removable pieces for adjusting the cross-sectional area of the inlet. In this alternate embodiment, the knockouts may be in the form of tubular sleeves that are configured so that the smaller sleeves fit within and lock into the larger sleeves. The sleeves may have any suitable shape corresponding to the cross-section of the inlet.

As noted before, in the exemplary embodiment, the fan unit 150 may be connected to the inlet 390 by any suitable duct 160. The duct 160 may have any suitable cross-sectional shape and size and be of any suitable length. The duct 160 may be constructed of any suitable material and may be flexible or rigid. In alternate embodiments, the inlet and fan unit, or fan unit housing may be mated without any intervening duct section. In still other alternate embodiments the fan unit or fan may be mounted within the inlet.

Figure 8B:
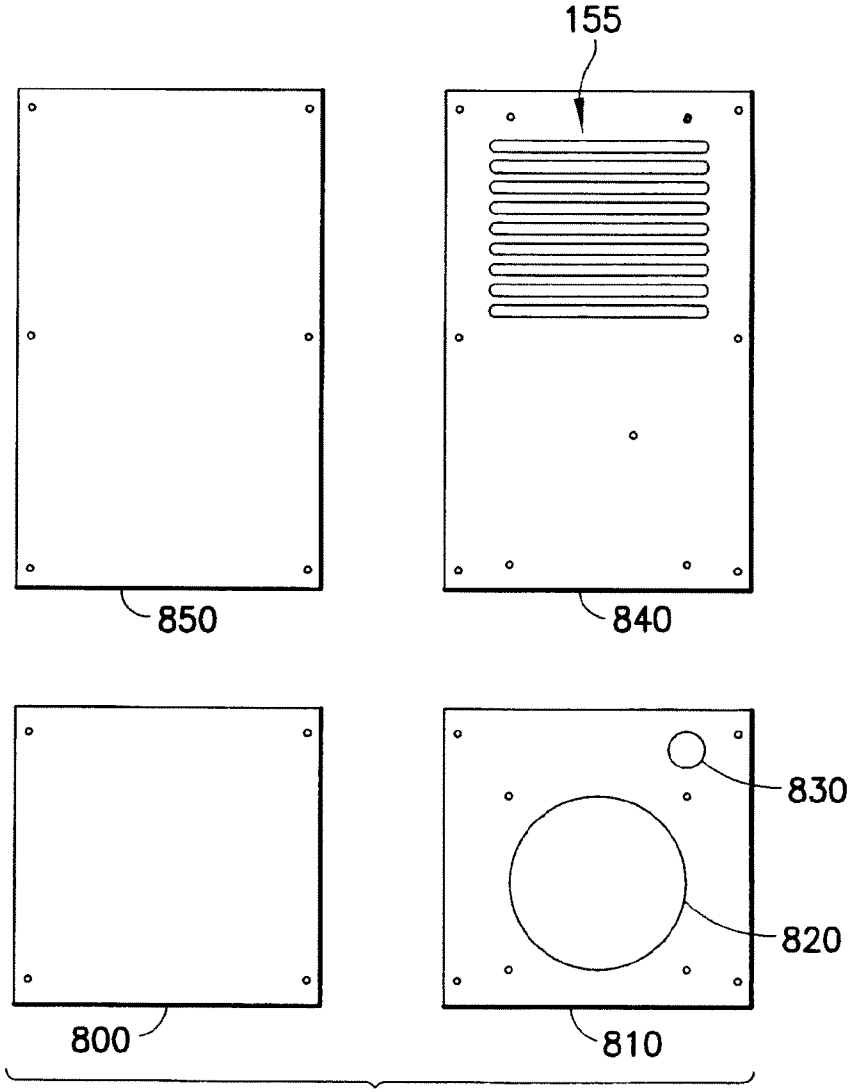
FIGS. 8A-8B illustrate an exploded view of the fan unit of FIGS. 7A-7C.
Figure 8A:
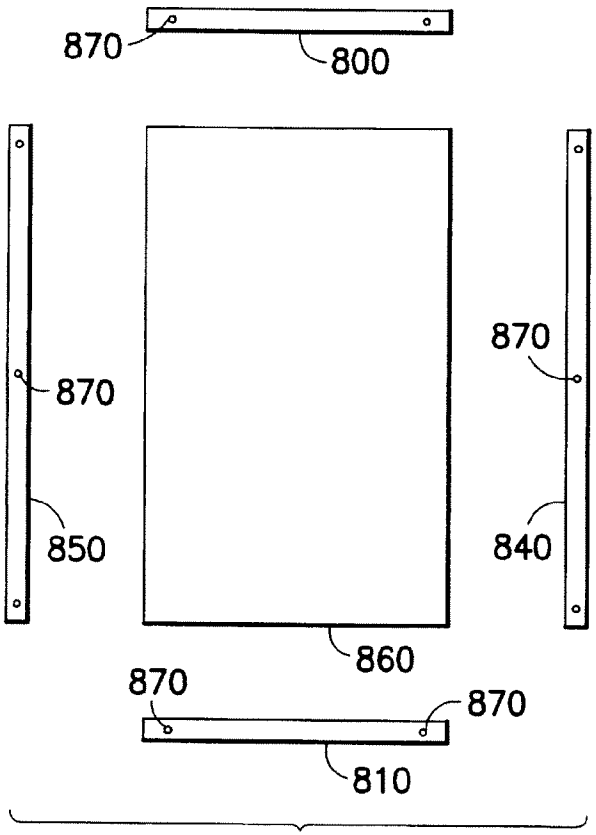

Referring now to FIGS. 3,4 and 7A-7C, in the exemplary embodiment the fan unit 150 may include a housing 350 and a fan 410. The fan unit 150 is shown in the Figures as having a box shaped housing 350. In alternate embodiments the housing 350 may have any suitable shape such as, for example, cylindrical. The housing 350 may be made of any suitable material such as, for example, metal or plastic. The housing 350 may be painted, coated or otherwise treated so that the housing 350 will not deteriorate, from for example, moisture. In this exemplary embodiment and as shown in FIGS. 8A-8B, the housing 350 may be constructed of a front 810, a back 800, a top 850, a bottom 840 and sides 860. The front 810, back 800, top 850 and bottom 840 may be provided with holes 870 that may be suitable for spot welding the different components of the housing together or in alternate embodiments, the holes 870 may be provided for any suitable fasteners such as self tapping screws. The front 810 of the housing 350 may have a hole 830 for power cord 700 to pass through. In alternate embodiments, the power cord 700 may be located through any suitable surface of the housing 350. The power cord 700 may be of any suitable length for supplying power to the fan unit 150.

The housing 350 may have an inlet 360 and an outlet or exhaust 155. The inlet 360 may be located in any suitable area of the housing 350 and have any suitable shape for connection to an air duct. For example, the front 810 of the housing 350 may have a hole 820 for inlet 360 to be attached. The housing 350 may have an exhaust section 155 having slots or any other suitable exhaust openings so that the air taken from the living area 200 may enter the crawlspace 115. The exhaust 155 may be louvered or have stationary or adjustable vanes for controlling the direction of the exhaust air flow. In this example, the exhaust 155 is shown as being on, for example, the bottom 840 of the housing 350. In alternate embodiments, the exhaust 155 may be in any suitable location on one or more surfaces of the housing 350 such as, for example, the sides 860. The inlet 360 and exhaust 155 may be connected to each other within the housing in any suitable manner such as by an internal duct. In alternate embodiments, the housing 350 may have internal guide vanes to direct the air flow out through the exhaust 155. In still other alternate embodiments the interior of the housing itself may act to direct the air flow from the inlet 360 to the exhaust 155. In other alternate embodiments, the fan unit may be located outside of the crawlspace such as in a bathroom wall or ceiling or outside the building so that the exhaust is piped or ducted into or otherwise introduced into the crawlspace in any desired location.

Figure 9:
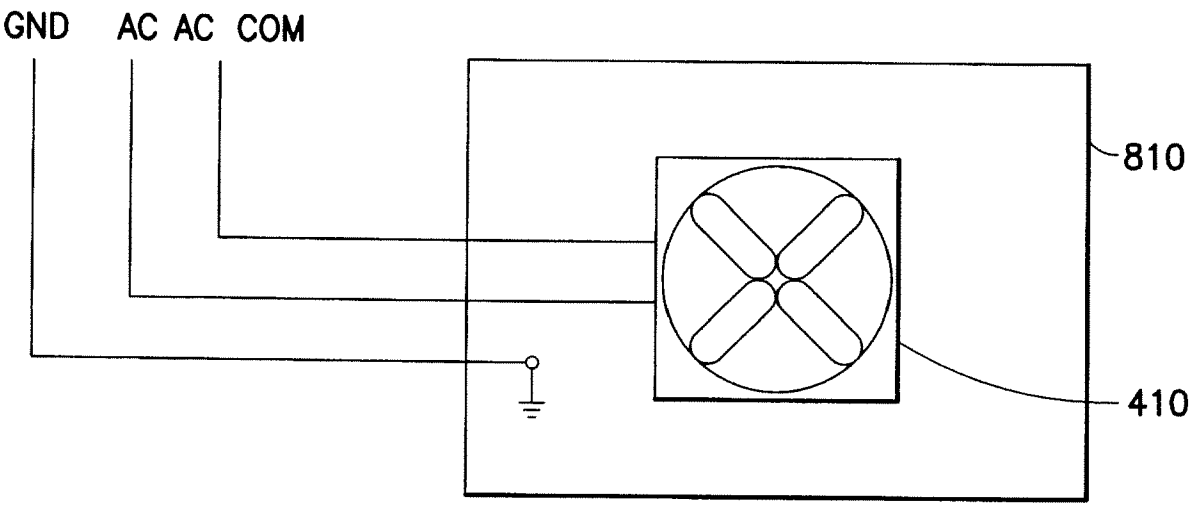
FIG. 9 shows a fan of the fan unit of FIGS. 7A-7C.
Figure 7A:
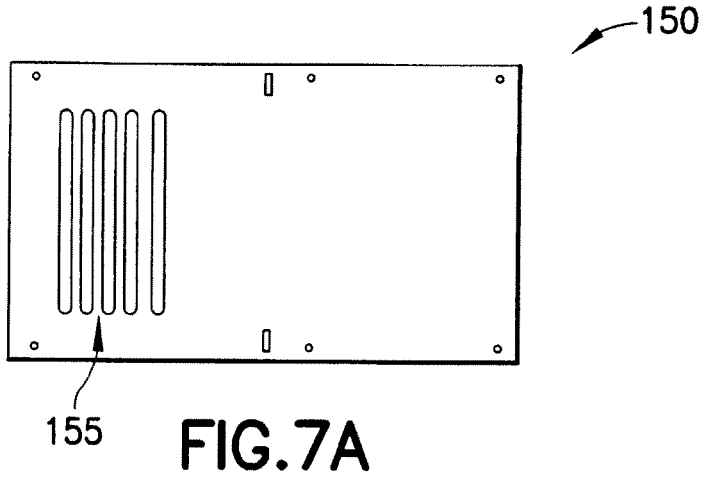
FIGS. 7A-7C show a fan unit in accordance with an exemplary embodiment.
Figure 7B:
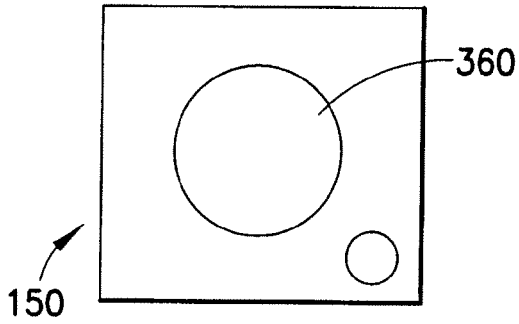
Figure 7C:
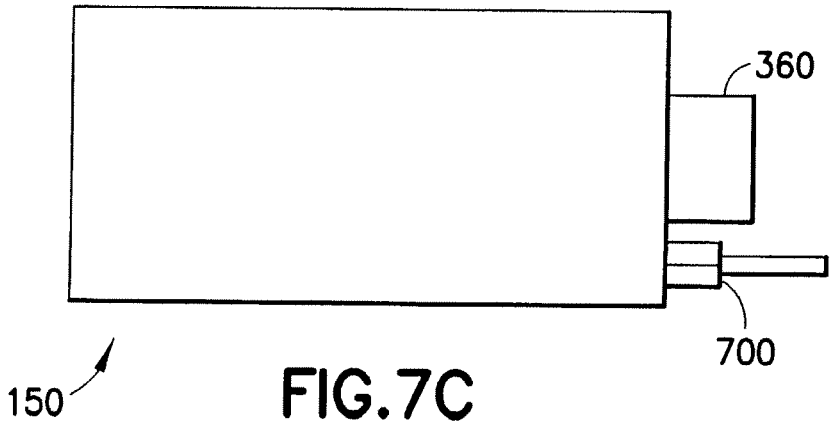

The fan 410 may be located in any suitable location such as within the housing 350 or outside the housing 350 such as, for example, at the inlet 360 of the housing 350. As can be seen in FIG. 9, the fan 410 may be mounted on the front 810 of the housing 350 inline with the inlet 360 and have, for example, a three wire AC power connection such as power cord 700. In alternate embodiments, the fan may be located in-line with internal ductwork of the housing 350. The motor for the fan 410 may integral with the fan such as with, for example, a box fan. The motor may be any suitable motor such as, for example, a variable speed motor or single speed motor having a low power consumption. In alternate embodiments, the motor may be located in any suitable location such as within the housing so as to be directly connected to the fan via a direct drive shaft. In other alternate embodiments the motor may be located outside the housing 350 or away from the fan 410 so as drive the fan 410 by, for example, belts, pulleys, shafts or a combination thereof. The fan unit 150 may be adapted to operate with any suitable voltage source and the power cord 700 may be configured to interact with any suitable power outlet. In alternate embodiments, fan unit 150 may be direct wired to a power source within the building structure 100 or powered by a battery or any other alternative power supply, such as solar power. The fan unit may operate continuously or be provided with a timer or switch and may be configured to automatically turn on when, for example, the temperature or humidity within the crawlspace reaches a predetermined level.

The fan unit 150, inlet 390 and duct 160 may be mounted in any suitable location within the crawlspace 115 such as, for example, between the floor joists 300 of the living area 200 above the crawlspace (e.g. the crawlspace ceiling) or on a wall of the crawlspace 115. The fan unit 150 may be mounted in any suitable manner, such as with any suitable hanging device, straps, brackets and the like. In alternate embodiments, the fan unit 150 may be configured as a floor unit that is placed on the floor 117 of the crawlspace 115 with duct work running up to the ceiling 220 of the crawlspace 115. In other alternate embodiments, the fan unit 150 may be located outside the crawlspace such as on or within a wall or ceiling of the habitable area 200 or as a standalone unit (floor unit) located within the habitable area 200 or outside the building.

Figure 3:
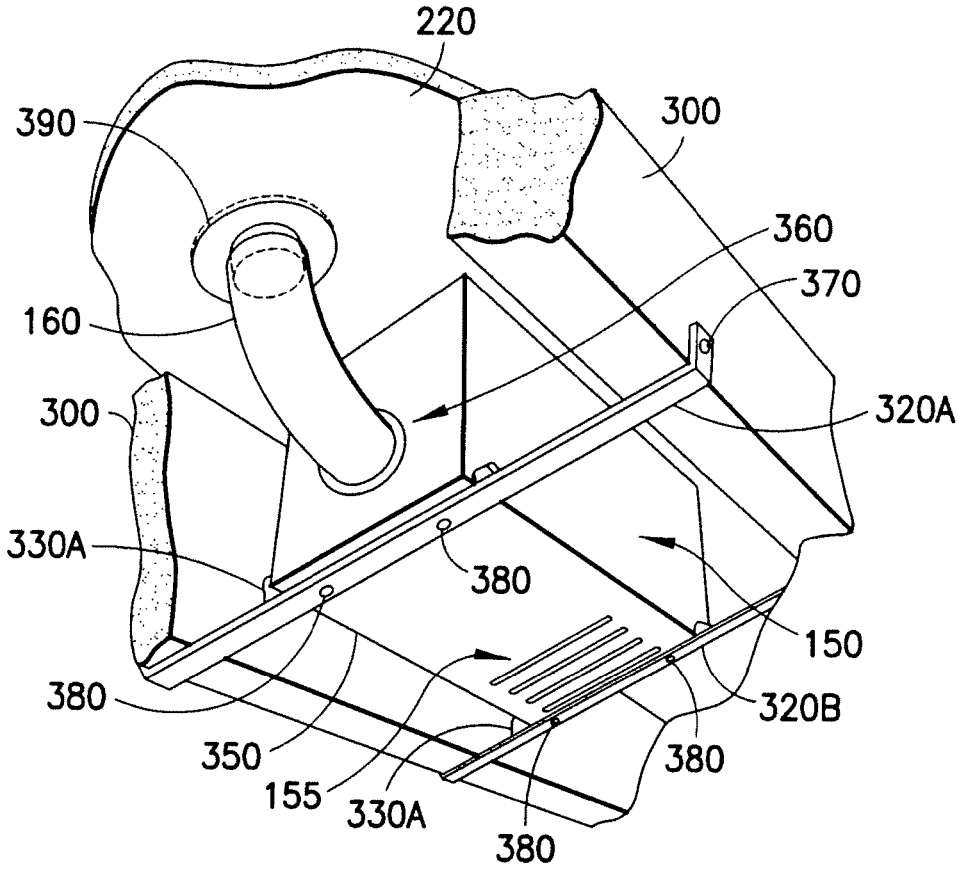
FIG. 3 shows an isometric view of an air apparatus in accordance with an exemplary embodiment.
Figure 4:
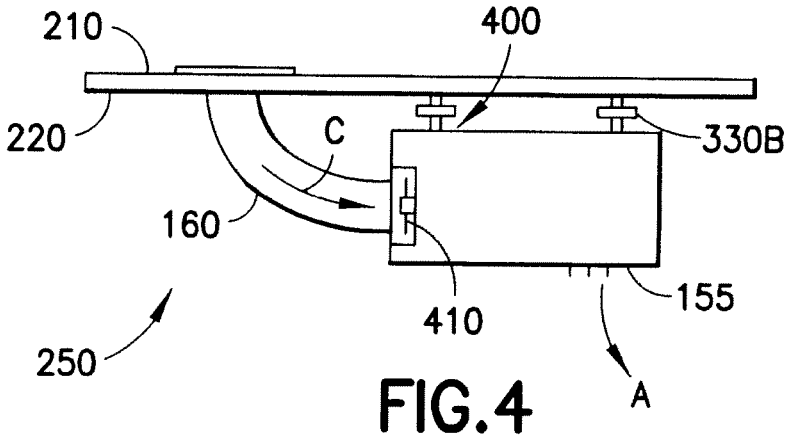
FIG. 4 illustrates a side view of an air apparatus in accordance with an exemplary embodiment.

As can be seen in FIGS. 3 and 4, for example, when the fan unit 150 is mounted between floor joists 300, straps 320A, 320B or any other suitable hanging device or bracket may be used to support the fan unit. The straps 320A, 320B may be any suitable straps such as, for example, metal strap 320. Metal strap 320 may be an aluminum strap having any suitable thickness. In alternate embodiments, strap 320 may be made of any suitable metal such as steel. In other alternate embodiments, the strap 320 may be made of any suitable material. The strap 320 may be provided with holes 610 for securing the strap to, for example the floor joists 300. The strap 320 may also have holes 600 for securing the fan unit 150 to the straps as will be described below. The straps may be affixed to the floor joists 300 in any suitable manner such as with screws, nails or any suitable fastening device 370. The fan unit 150 may be fixed to the straps 320A, 320B by, for example, any suitable number of fasteners 380 that run through, for example holes 600 in straps 320A, 320B and into the housing 350. In alternate embodiments, the housing 350 may be provided with recesses to engage the straps 320A, 320B and prevent movement of the fan unit 150 during operation. In alternate embodiments, the fan unit may be prevented from moving or attached to its mounting hardware in any suitable manner.

To isolate and/or reduce noise, resonant vibration and structure-borne noise from passing from the fan unit 150 into the living or habitable area 200, the fan unit 150 may be separated or isolated from its mounting surface (in this example, the straps 320A, 320B) by isolation pads or dampers 330A. The dampers may be constructed of any suitable damping material such as, for example, rubber, elastomeric pads, neoprene or vinyl materials. In this example, the dampers 330A may be located between the straps 320A, 320B and the fan unit 150. In alternate embodiments, the dampers may be located in any suitable location such as, for example, between a wall and a bracket for mounting the fan unit to the wall. In other alternate embodiments the dampers may be incorporated into a stand or be provided as feet where the fan unit is in a floor unit configuration. As can be seen in FIG. 4, dampers 330B may also be located above the fan unit 150 such as when hangers 400 are utilized for mounting the fan unit 150 to the ceiling 220 of the crawlspace 115. In FIG. 4, the dampers 330B are shown as being incorporated into the hangers 400 (i.e. isolation hangers). In alternate embodiments the dampers may be pads located between the hangers 400 and the fan unit 150 or between the hangers 400 and the ceiling 220. In other alternate embodiments, the hangers may be any suitable isolation hangers or incorporate any suitable damping device.

Referring now to FIG. 2, the air apparatus 250 may provide conditioned air from the living or otherwise habitable area 200 to, for example, the sealed crawlspace 115. The air in the habitable area 200 may be dried and conditioned by, for example, dehumidifiers, central air conditioning systems, wall mounted air conditioners, window mounted air conditioners or any other suitable air conditioning system within the living area 200.

The fan 410 of the fan unit 150 may cause the dry conditioned air from the living area 200 to be drawn into the inlet 390 of the air apparatus 250 as indicated by the arrows C. The inlet 390 may be surface mounted on or flush mounted in a floor 210 or a wall 215 of the habitable area 200. In alternate embodiments the inlet 390 may be located in any desired location within the habitable area. The conditioned air is passed from the inlet 390 through the duct 160 and into the fan unit 150. The duct 160 may have any suitable length and may be routed in any suitable manner along any suitable path to create an airtight connection between the inlet 390 and the fan unit 150. The conditioned air passes through the fan unit 150 and exits into the crawlspace 115 through the fan unit's exhaust 155 as indicated by the arrows A. For exemplary purposes, the flow rate of the air produced by the fan unit 150 entering the crawlspace may be approximately 90 CFM depending on the size of the crawlspace. In alternate embodiments, the fan unit 150 may provide a flow rate of air entering the crawlspace that may be more or less than 90 CFM. The conditioned air mixes with the air in the crawlspace 115 and in the exemplary embodiment the mixed air returns into the habitable area 200 as indicated by the arrows B through, for example existing penetrations between the crawlspace and the habitable space 200. The existing penetration may be, for example, gaps in the joints or openings of floorboards or walls. In alternate embodiments, the mixed air may return to the habitable area 200 through return vents or floor registers 270 installed in the floor 210 and/or walls 215 of the living area 200. The floor registers 270 may be any suitable registers having any suitable shape and size. The registers 270 may be surface mounted on or flush mounted in any suitable surface of the living area 200 such as, for example, a floor 210 or a wall 215. The mixed air that is returned to the living area 200 may be re-conditioned by the air conditioning devices of the living area 200. The re-conditioned air is available for recirculation into the crawlspace creating a continuous cycle of air that may provide a substantially limitless source of conditioned air. In alternate embodiments, all of or a portion of the mixed air may be released to the atmosphere outside of the building through, for example, passive vents (where the air pressure within the crawlspace is greater than the atmospheric pressure outside the building, or by forced evacuation via a fan or air pump.

The mass flow rate of air entering the crawlspace may be balanced with the mass flow rate of air exiting the crawlspace through the gaps in the joints or openings of the floorboards or walls and/or through the floor registers. The floor registers and inlet 390 of the air circulation system may have air passages having substantially similar internal dimensions (i.e. air passage dimensions) so that the mass flow rate of air into the crawlspace 115 substantially matches the mass flow rate of air exiting the crawlspace 115. Where the number of floor registers is not equal to the number of inlets the sum of the cross-sectional area of the air passages for the floor registers may be substantially equal to the sum of the cross-sectional area of the air passages for the inlets. The floor registers may also be adjusted in a substantially similar manner as the inlet 390 so that the mass flow rate of air from the crawlspace 115 into the living area 200 may be balanced with the mass flow rate of the air flowing through the air apparatus 250. In alternate embodiments, the fan unit 150 may have an adjustable fan and/or the floor registers may each have an adjustable speed fan so that the mass flow rate may be adjusted by adjusting the speed of the fan 410 and the fan speed of the floor registers. In this alternate embodiment, the fan 410 of the fan unit 150 and the fan of the floor registers may be configured so that their speeds are matched (e.g. the flow rate are matched) to create a balanced air flow into and out of the crawlspace 115. The mass flow rate of air may be adjusted for any suitable reasons such as, for example, to allow the mixed air returning to the living area 200 sufficient time to be reconditioned or to compensate for increased humidity within the crawlspace 115. In alternate embodiments, the air flow rates may be adjusted so that the flow of air into the crawlspace does not match the flow rate of the air exiting the crawlspace. Where desired the flow rates of air into and out of the crawlspace may be adjusted to create, for example, a positive or negative pressure within the crawlspace.

The disclosed embodiments provide a crawlspace air circulation system for transferring conditioned air from a living or otherwise habitable area, into for example, a crawlspace. The air apparatus of the exemplary embodiments may also be installed in a basement or any other suitable location (e.g. within or outside the building with suitable ducting) to circulate conditioned air from a living area into the crawlspace, basement or other suitable location. This continuous cycle of circulating air may provide a constant exchange of air within an area such as a sealed crawlspace to prevent stale air and the growth of mold and the rotting of building structure components.

It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

What is claimed is:

1. A crawlspace encapsulation system for encapsulating a crawlspace of a building, the system comprising:

a substantially impermeable barrier layer disposed in the crawlspace and isolating at least a portion of the crawlspace from an outside atmosphere forming an encapsulated crawlspace substantially sealed from vapors outside the building, the substantially impermeable barrier layer being sealed contiguous to the top edge of a building foundation wall by a continuous peripheral sealing bead; and an air circulation system including a fan unit located in the encapsulated crawlspace, a single air outlet disposed in a bottom surface of the fan unit that directs air downwardly towards a floor of the crawlspace, and only one air inlet opening, the air inlet opening located on a floor separating a habitable area of the building from the crawlspace, wherein air from the habitable area of the building is drawn by the fan unit into the air inlet opening; and wherein, the air circulation system mixes air from the habitable area of the building with crawlspace air substantially throughout the encapsulated crawlspace so that mixed air is substantially distributed throughout the encapsulated crawlspace, and wherein the air circulation system pressurizes the encapsulated crawlspace relative to the outside atmosphere.

2. The system of claim 1, wherein the air circulation system is arranged to circulate interior building air of at least the habitable area of the building.

3. The system of claim 1, wherein the air circulation system further includes an exhaust that communicably connects the encapsulated crawlspace to the building.

4. The system of claim 1, wherein the air is conditioned air from the habitable area.

5. The system of claim 1, wherein the air circulation system is configured so that the return air from the encapsulated crawlspace is reconditioned in the habitable area.

6. The system of claim 1, wherein the air circulation system is configured so that an amount of air entering and exiting the encapsulated crawlspace is adjustable.

7. The crawlspace encapsulation system of claim 1, wherein the barrier layer forms a boundary between a high pressure region within the encapsulated crawlspace and a low pressure region outside of the encapsulated crawlspace.

8. A crawlspace encapsulation system for encapsulating a crawlspace of a building, the system comprising:

a substantially impermeable barrier layer disposed in the crawlspace and isolating at least a portion of the crawlspace from an outside atmosphere forming an encapsulated crawlspace substantially sealed from the outside atmosphere, the substantially impermeable barrier layer being sealed contiguous to the top edge of a building foundation wall by a continuous peripheral sealing bead; and an air exchange system including a fan unit located in the encapsulated crawlspace, a single air outlet disposed in a bottom surface of the fan unit that directs air downwardly towards a floor of the crawlspace, and only one air inlet opening, the air inlet opening located on a floor separating a habitable area of the building from the crawlspace, wherein air from the habitable area of the building is drawn by the fan unit into the air inlet opening; and wherein, the air exchange system mixes the air drawn from the habitable area of the building with crawlspace air substantially throughout the encapsulated crawlspace so that mixed air is substantially distributed throughout the encapsulated crawlspace, and wherein the air exchange system pressurizes the encapsulated crawlspace relative to the habitable area of the building.

9. The system of claim 8, wherein the air exchange system returns air from the encapsulated crawlspace to an area of the building that is different than the crawlspace.

10. An air circulation system for a building having a habitable portion and a crawlspace, the system comprising:

a crawlspace encapsulation system for isolating the crawlspace from an outside atmosphere forming a substantially encapsulated crawlspace substantially sealed from an outside atmosphere, the crawlspace encapsulation system including a substantially impermeable barrier layer being sealed contiguous to the top edge of a building foundation wall by a continuous peripheral sealing bead; and a fan unit located in the encapsulated crawlspace, a single air outlet disposed in a bottom surface of the fan unit that directs air downwardly towards a floor of the crawlspace, and only one air inlet opening, the air inlet opening located on a floor separating a habitable portion of the building from the crawlspace, wherein air from the habitable portion of the building is drawn by the fan unit into the air inlet opening; and wherein, the fan unit pressurizes the encapsulated crawlspace relative to the habitable portion of the building, and wherein the fan unit mixes the air drawn from the habitable portion of the building with crawlspace air substantially throughout the enclosed crawlspace so that mixed air is substantially distributed throughout the encapsulated crawlspace.

11. The system of claim 10, wherein the air is conditioned air.

12. The system of claim 10, wherein the fan unit is attached to a mounting surface within the encapsulated crawlspace.

13. The system of claim 12, wherein a damping device isolates the fan unit from the mounting surface within the encapsulated crawlspace.

14. The system of claim 10, wherein air from the encapsulated crawlspace is returned to the habitable portion of the building.

15. The system of claim 14, wherein air is returned to the habitable portion of the building through at least one of a return register, or opening in the building formed by at least one of a floor or wall penetration or floor or wall joint.

16. The system of claim 10, wherein an amount of air entering the encapsulated crawlspace is greater than an amount of air exiting the crawlspace.

17. The system of claim 10, wherein an air conditioning device for the habitable area of the building conditions the air directed into the encapsulated crawlspace.

18. The system of claim 10, wherein an amount of air entering the crawlspace and an amount of air exiting the encapsulated crawlspace are adjustable.

19. The system of claim 10, wherein an air inlet device defining the air inlet opening further comprises removable portions for adjusting a mass flow rate of air through the inlet.

* * * * *